US005339912A

United States Patent [19]

Hosie et al.

[11] Patent Number: 5,339,912

[45] Date of Patent: Aug. 23, 1994

[54] CUTTINGS DISPOSAL SYSTEM

[75] Inventors: Stanley Hosie; Callum J. B. Dinnes, both of Aberdeen, Scotland

[73] Assignee: ABB Vetco Gray Inc., Houston, Tex.

[21] Appl. No.: 37,781

[22] Filed: Mar. 26, 1993

[51] Int. Cl.[5] ..... E21B 21/06

[52] U.S. Cl. ..... 175/66; 175/206; 175/207

[58] Field of Search ..... 175/66, 88, 206, 207, 175/217; 166/266, 268

[56] References Cited

U.S. PATENT DOCUMENTS

| | | | |
|---|---|---|---|
| 2,919,898 | 1/1960 | Marwil et al. | 175/66 |
| 3,766,997 | 10/1973 | Heilhecker et al. | 175/66 |
| 3,774,702 | 11/1973 | Elenburg | 175/206 X |
| 4,222,988 | 9/1980 | Barthel | 175/66 X |
| 4,793,423 | 12/1988 | Knol | 175/66 |
| 4,913,245 | 4/1990 | Skinner | 175/66 |
| 4,942,929 | 7/1990 | Malachosky et al. | 175/207 X |
| 5,129,469 | 7/1992 | Jackson | 175/207 X |

*Primary Examiner*—William P. Neuder
*Attorney, Agent, or Firm*—James E. Bradley

[57] ABSTRACT

An injection adapter allows injection of oil base cuttings produced by an injection well into an annulus surrounding one of the strings of casing in the injection well. The injection well has inner and outer wellhead housings with at least one casing hanger installed in the inner wellhead housing. A port extends through the casing hanger to an annulus surrounding the casing. A closure sleeve will selectively close the port. An injection adapter removably lands in the bore of the casing hanger when the port is open. The injection adapter seals in the casing hanger and is connected to a pump at the surface for pumping the slurry into the annulus.

29 Claims, 3 Drawing Sheets

CUTTINGS DISPOSAL SYSTEM

BACKGROUND OF THE INVENTION

1. Field of the invention

This invention relates in general to equipment for pumping cuttings generated from drilling a subsea well back into another subsea well, and in particular to an adapter that connects an injection line to the inner wellhead housing.

2. Description of the Prior Art

When a subsea well is drilled, cuttings, which are small chips and pieces of various earth formations, will be circulated upward in the drilling mud to the drilling vessel. These cuttings are separated from the drilling mud and the drilling mud is pumped back into the well, maintaining continuous circulation while drilling. The cuttings in the past have been dumped back into the sea.

While such practice is acceptable for use with water based drilling muds, oil based drilling muds have advantages in some earth formations. The cuttings would be contaminated with the oil, which would result in pollution if dumped back into the sea. As a result, environmental regulations now prohibit the dumping into the sea cuttings produced with oil based drilling mud. There have been various proposals to dispose of the oil base cuttings. One proposal is to inject the cuttings back into a well. The well could be the well that is being drilled, or the well could be an adjacent subsea well. Various proposals in patents suggest pumping the cuttings down an annulus between two sets of casing into an annular space in the well that has a porous formation. The cuttings would be ground up into a slurry and injected into the porous earth formation. Subsequently, the well receiving the injected cuttings would be completed into a production well.

U.S. Pat. No. 5,085,277, Feb. 4, 1992, Hans P. Hopper, shows equipment for injecting cuttings into an annulus surrounding casing. The equipment utilizes piping through the template or guide base and through ports in specially constructed inner and outer wellhead housings. While feasible, the method taught in that patent requires extensive modification to conventional subsea structure. At the present, no equipment is commercially being used for injecting cuttings into an annulus surrounding casing.

SUMMARY OF THE INVENTION

In this invention, the cuttings being generated from a well are injected into an adjacent well, which may be considered initially to be an injection well. The injection well has an inner wellhead housing landed in an outer wellhead housing. At least one casing hanger is installed in the inner wellhead housing, the casing hanger having an axial bore and being secured to a string of casing. A port extends through the casing hanger to an annulus surrounding the casing. A closure sleeve is carried in the casing hanger for selectively opening and closing the port.

An injection adapter removably lands in the bore of the casing hanger. The injection adapter has a passage through it which communicates with the port when the port is open. The injection adapter is sealed in the bore of the casing hanger and in the inner wellhead housing. The injection adapter is connected to a hose or line leading to a pump at the rig which delivers a slurry of the cuttings from an adjacent well being drilled.

DETAILED DESCRIPTION OF THE INVENTION

Figure 1:
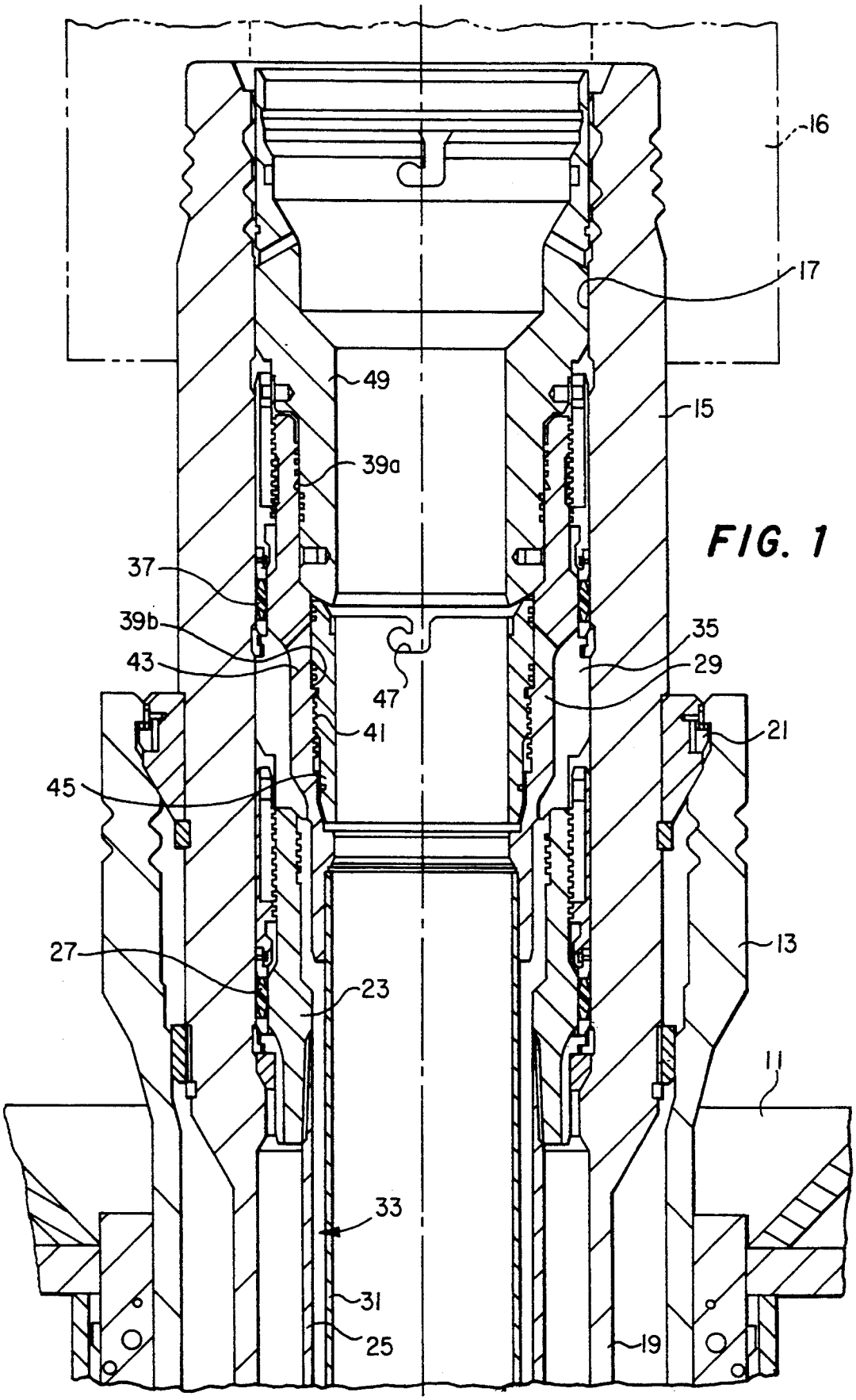
FIG. 1 a vertical cross-sectional view of a subsea wellhead constructed in accordance with this invention, and shown prior to receiving the injection adapter.

Referring to FIG. 1, a conventional template or guide base 11 will be located on the sea floor. An outer wellhead housing 13, also conventional, installs in guide base 11. Outer wellhead housing 13 is secured to a string of conductor pipe (not shown), which is typically 30 inches in diameter. An inner wellhead housing 15 lands in outer wellhead housing 13. Inner wellhead housing 15 is also conventional. Inner wellhead housing 15 will be run and landed using a threaded or cam type running tool or drill pipe, and cemented through drill pipe. Then a blowout preventer (not shown) will be run on riser and connected to the top of inner wellhead housing 15 using a hydraulic blowout preventer connector 16, which is located at the lower end of the riser. Wellhead connector and riser 16 include a blowout preventer (not shown), and extend to a drilling platform at the surface.

Inner wellhead housing 15 has an axial bore 17. A string of outer casing 19, typically 20 inches in diameter, secures to the lower end of inner wellhead housing 15. A locking device 21 latches inner wellhead housing 15 in outer wellhead housing 13.

After installation of inner wellhead housing 15, the well will be drilled to a greater depth through the wellhead connector and riser 16. A lower casing hanger 23 will then be installed in inner wellhead housing 15. Lower casing hanger 23 is conventional and secures to a string of intermediate casing 25, typically 13 ⅜ths inches in diameter. Casing hanger seal 27 will seal the exterior of lower casing hanger 23 to bore 17 of inner wellhead housing 15. Seal 27 is installed after intermediate casing 25 is cemented in place.

Then, the well will be drilled to a greater depth, which in the embodiment shown will be its total depth. An upper casing hanger 29 will be installed on top of lower casing hanger 23. Upper casing hanger 29 secures to the upper end of a string of inner casing 31, which is typically 9 ⅝ths inches in diameter. An annulus 33 will surround inner casing 31. Annulus 33 locates between inner casing 31 and intermediate casing 25 to the lower end of intermediate casing 25. Then, annulus 33 is located between the earth formation, in open hole, to the lower end of inner casing 31.

In a prior art conventional completion, annulus 33 would be cemented fully, with cement returns returning through flowby slots 35 up the exterior of upper casing hanger 29. The cement would extend at least up into the portion of annulus 33 between the inner casing 31 and intermediate casing 25. In this invention, however, only a lower section of the annulus 33 will be cemented. This lower section will not extend up to the lower end of intermediate casing 25. The cement will extend up past formations of interest where oil production is likely.

This will leave a space between the top of the initial cement and the lower end of intermediate casing 25 that is open to the earth formations, some of which will be porous. Cuttings slurry will be injected into these porous formations. During this initial cementing, conventional circulation up flowby slots 35 will take place. Then, a conventional casing hanger seal 37 will be installed between the exterior of upper casing hanger 29 and inner wellhead housing 15.

Casing hanger 29 has an axial bore with an upper section 39*a* and a lower section 39*b* of lesser inner diameter. A set of tieback threads 41 are located in lower section 39*b*. Casing hanger 29 is basically conventional except for a plurality of annulus ports 43 which extend from bore lower section 39*b* into the flowby slots 35. Annulus ports 43 communicate annulus 33 with casing hanger bore sections 39*a* and 39*b*.

During the installation of upper casing hanger 29, the cementing of the lower end of inner casing 31 and subsequent testing, a closure sleeve 45 will close annulus ports 43. Closure sleeve 45 is a removable sleeve that inserts into bore lower section 39*b*, and sealingly blocks the annulus port 43. In the embodiment shown, closure sleeve 45 engages tieback threads 41 to hold it in place. J-slots 47 in closure sleeve 45 enable it to be engaged by a conventional running tool to remove closure sleeve 45 at a later time. Also, during the running and testing operations, a wear bushing 49 will be located in casing hanger bore upper section 39*a*.

Figure 2:
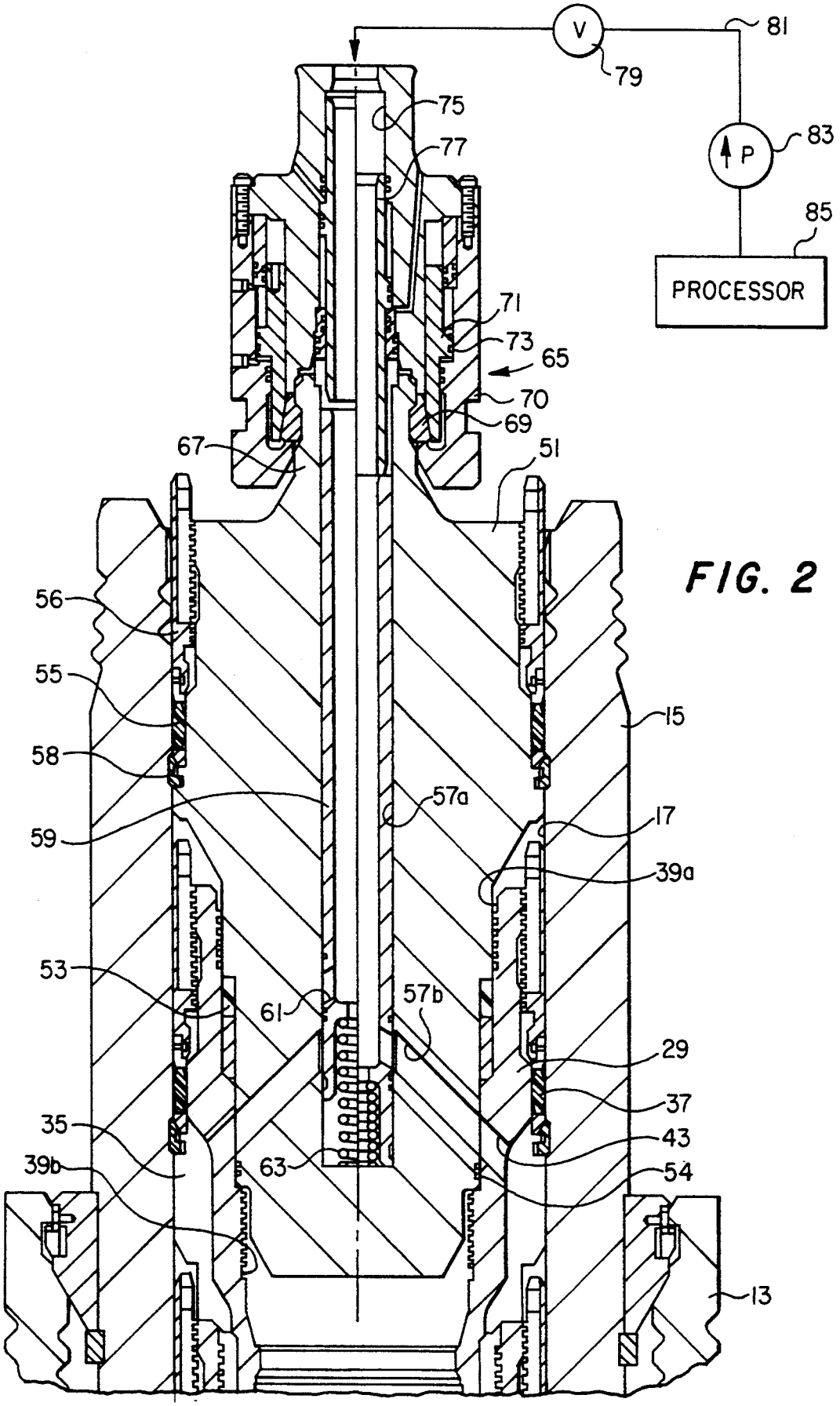
FIG. 2 is a vertical cross-sectional view of the subsea wellhead of FIG. 1, showing an injection adapter constructed in accordance with this invention in place.

The first well to be drilled on the guide base 11 may be drilled with water based drilling mud, or if drilled with oil based muds, the cuttings could be stored on the surface prior to using the well as an injection well. Referring to FIG. 2, after the well has been drilled and configured as shown in FIG. 1, the operator will lower a running tool to remove wear bushing 49 and closure sleeve 45. The operator then lowers an injection adapter 51 through wellhead connector and riser 16, using a running tool. Injection adapter 51 is a tubular member that inserts sealingly within inner wellhead housing 15 and upper casing hanger 29. Injection adapter 51 has a weight set seal 53 on its exterior that will seal in upper bore section 39*a* of upper casing hanger 29. Elastomeric seals 54 seal in bore lower section 39*b*. An annulus seal 55, similar to casing hanger seals 27 and 37, will locate between the exterior of the upper portion of injection adapter 51 and bore 17 of inner wellhead housing 15. Annulus seal 55 is energized by a threaded drive nut 56. When moved downward by drive nut 56, annulus seal 55 moves a retainer ring 58 outward into a recess in bore 17 to lock injection adapter 51 in place.

Injection adapter 51 has a flow passage therethrough which includes an axial portion 57*a* and a plurality of lateral portions 57*b*. Lateral portions 57*b* register with annulus ports 43 so as to communicate annulus 33 with passage axial portion 57*a*. An internal sleeve valve 59 locates slidably in passage axial portion 57*a*. Internal sleeve valve 59 moves between the upper closed position shown on the left side of FIG. 2 to the lower open position shown on the right side of FIG. 2. Internal sleeve valve 59 has a port 61 that registers with each lateral passage 57*b*. Ports 61 are moved out of alignment with passage lateral portions 57*b* when internal sleeve valve 59 is in the upper closed position. A spring 63 urges sleeve valve 59 to the upper closed position.

A hydraulic actuator 65 is subsequently connected to injection adapter 51 to move internal sleeve valve 59 to the open position, compressing spring 63. Actuator 65 releasably mounts to a protruding neck 67 on injection adapter 51. After annulus seal 55 is set and the running tool removed, the wellhead connector and riser 16 is removed. The actuator 65 is lowered on a tugger line with the assistance of a remote operated vehicle.

Actuator 65 has a tubular housing 70 that encircles neck 67. A lock ring 69 is carried in housing 70 for engaging a recess formed on neck 67. A cam sleeve 71 has a piston 73. When supplied with hydraulic pressure, cam sleeve 71 moves downward, causing lock ring 69 to engage the recess on neck 67. Upward movement of cam sleeve 71 will release lock ring 69 to remove actuator 65.

Actuator 65 has an axial bore 75. An actuator piston 77 slides axially in bore 75. Actuator piston 77 has a lower end that will contact the upper end of internal sleeve valve 59 to move it downward to the open position. Actuator piston 77 is supplied with hydraulic pressure to stroke it between the upper closed position shown on the left side of FIG. 2 to the open lower position shown on the right side of FIG. 2. If hydraulic pressure fails, spring 63 will push internal sleeve valve 59 to the closed position.

The equipment also includes a manual valve 79 which will be mounted to the upper end of actuator 77 and can be a variety of types. Manual valve 79 is used for emergency purposes, and would be opened and closed by a remote operated vehicle in the event that closure is necessary due to leakage. A coupling (not shown) releasably couples manual valve 79 to a line 81. Line 81, preferably a flexible hose, extends to the surface vessel. The lower end of line 81 will be secured to the coupling and to the manual valve 79 and actuator 65 at the surface and lowered onto the injection adapter 51 along with the hydraulic lines for actuator 65. A slurry pump 83 will be located at the drilling platform for pumping through line 81 and valve 79 into the bore 75 and passage portions 57*a*, 57*b*.

A processor 85 will process the cuttings being generated by drilling in an adjacent well. Processor 85 may be of various types, and will typically reduce the size of the cuttings by grinding, then mixing them with water to form the slurry. Processor 85 may be of a type described in U.S. Pat. Nos. 5,085,277, Feb. 4, 1992, Hans P. Hopper, or U.S. Pat. No. 4,942,929, Jul. 24, 1990, Edward Malachosky, et al.

Figure 3:
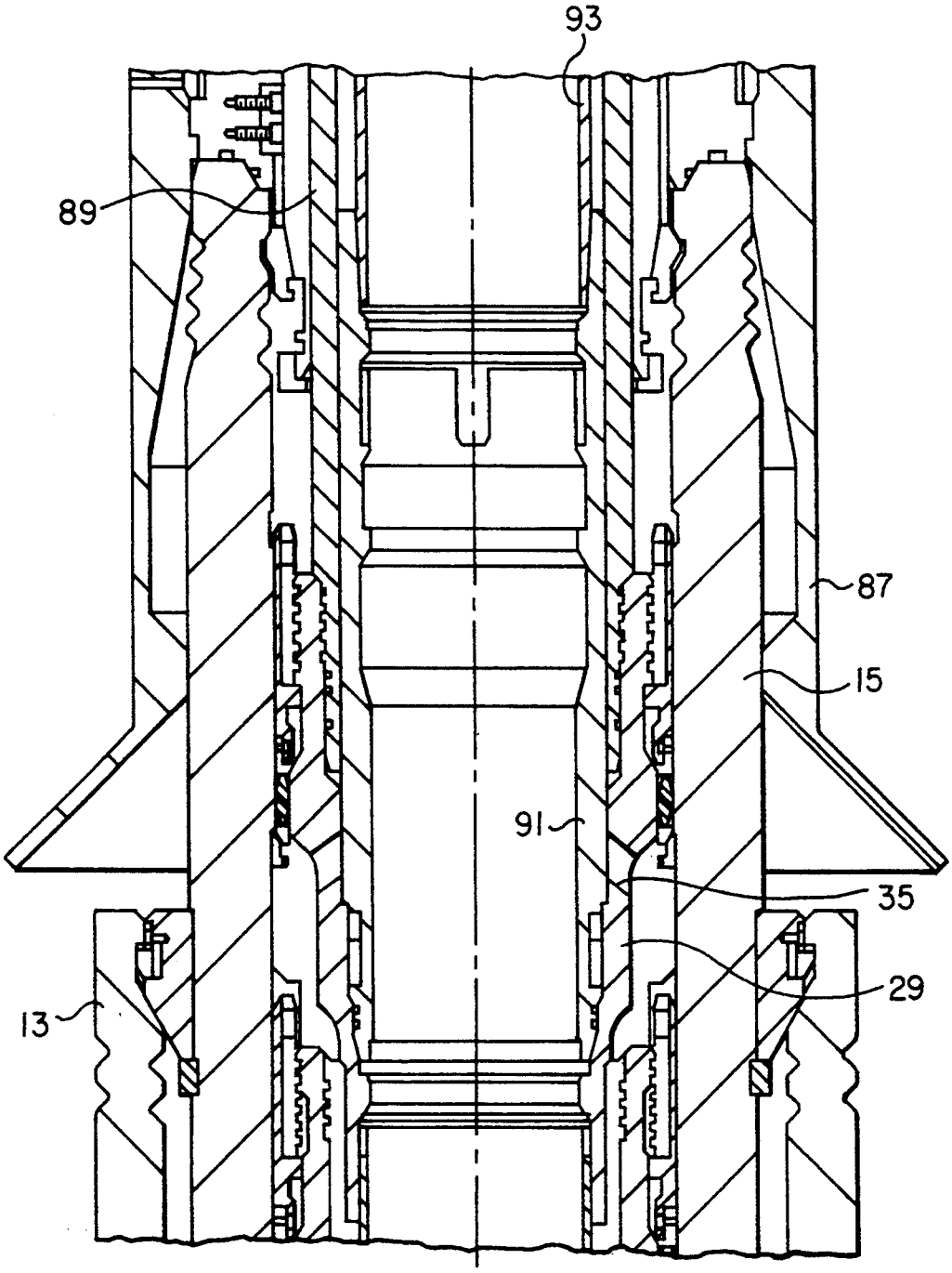
FIG. 3 is a vertical cross-sectional view of the subsea wellhead of FIG. 1, showing the injection adapter removed after injection has been completed, and shown installed with a tieback connector for production purposes.

Referring to FIG. 3, the injection well will be subsequently converted to production purposes. A funnel 87 will be lowered over inner wellhead housing 15. Funnel 87 connects to a tieback riser that extends to the vessel. A conventional outer tieback connector 89 will engage bore upper section 39*a* of upper casing hanger 29. Outer tieback connector 89 connects to outer tieback conduit that extends to the vessel. An inner tieback connector 91 is lowered into bore lower section 39*b* and secured to tieback threads 41. Tieback conduit 91, which is casing of the same diameter as inner casing 31, will extend to the vessel. Inner tieback connector 91 is also conventional. The well will then be completed as a conventional tieback.

In operation, a template or guide base 11 will be installed on the sea floor. Then, the operator will drill an initial well using water base drilling mud. The initial well will appear as in FIG. 1, containing an outer wellhead housing 13, an inner wellhead housing 15, a lower casing hanger 23 and an upper casing hanger 29. When installing upper casing hanger 29 and inner casing 31, only a lower portion of the annulus 33 surrounding inner casing 31 will be cemented. A portion of the open hole surrounding inner casing 31 will be remaining for injecting a slurry of cuttings.

Once the well is completed as shown in FIG. 1, the operator removes wear bushing 49 and closure sleeve 45. This opens annulus ports 43 to annulus 33. The operator then installs injection adapter 51 (FIG. 2), through the wellhead connector and riser 16, and also through the blowout preventers (not shown) connected in the string of riser. The running tool secures to the drive nut 55. Seals 53 energize due to weight. The operator will rotate the running tool to energize seal 55 between the exterior of injection adapter 51 and inner wellhead housing 15. The operator handles this by rotating drive nut 56. The operator retrieves the running tool.

The operator then removes wellhead connector and riser 16 (FIG. 1). A tugger line (not shown) will connect the injection adapter 51 to the surface vessel. The wellhead connector and riser 16 will be positioned for drilling an adjacent well.

Then by using the tugger line and a remote operated vehicle, the actuator 65, valve 79 and lower end of line 81 will be secured to injection adapter 51. Hydraulic pressure from the surface will be supplied to cam sleeve 71 for connecting lock ring 69 and actuator 65 to neck 67 of injection adapter 51. Once injection is to begin, hydraulic pressure will be supplied to actuator piston 77, which will move to the lower position. This pushes sleeve valve 59 downward, registering its ports 61 with the lateral passage portions 57*b*.

Processor 85 will process cuttings returning from the drilling of the adjacent well. Processor 85 will grind the cuttings into a smaller size and mix them in a slurry. Pump 83 will pump the slurry down line 81. The slurry flows through bore 75, passage portions 57*a* and 57*b*, annulus ports 43, and down annulus 33. The slurry flows into the open formation. The injection process takes place while an adjacent well is being drilled.

The injection well will normally receive cuttings from several wells being drilled on the same template. Once the injection has been completed, the operator will then pump cement down line 81. The cement flows into annulus 33, cementing the open hole portion of annulus 33. After the cement has cured, the operator will then retrieve injection adapter 51. If the well is to remain for some time before tieback, the operator may reinstall closure sleeve 45 and a cap.

Once the operator desires to convert the well of FIGS. 1 and 2 into production purposes, he will remove the cap and install tieback funnel 87. The operator installs tieback connector string 89 and retrieves closure sleeve 45. The operator then installs tieback connector 91 in a conventional manner. The well is then completed conventionally for production purposes. The well could also be completed as a subsea tree installation, rather than a tieback installation.

The invention has significant advantages. The injection adapter allows the injection of cuttings into an annulus surrounding one of the strings of casing. The injection adapter requires no modification to the template or guide base, nor to the inner or outer wellhead housings. The only subsea modification required is a special upper casing hanger. The injection equipment required downhole is relatively inexpensive and simple in structure.

While the invention has been shown in only one of its forms, it should be apparent to those skilled in the art that it is not so limited, but is susceptible to various changes without departing from the scope of the invention.

We claim:

1. In an injection well having an outer wellhead housing, an inner wellhead housing landed in the outer wellhead housing, at least one casing hanger landed in the inner wellhead housing, the casing hanger having an axial bore and being secured to a string of casing, pump means for delivering a slurry of well cuttings produced from the drilling of another well, the improvement comprising in combination:

a port extending through the casing hanger to an annulus surrounding the casing;

an injection adapted which removably lands in the bore of the casing hanger, the injection adapter having a passage therethrough which is adapted to communicate with the port;

lower seal means for sealing the injection adapter in the bore of the casing hanger; and connection means for connecting the passage of the injection adapted to the pump means for delivering the slurry through the passage and port into the annulus.

2. The injection well according to claim 1 further comprising a closure means for selectively closing the port when the injection adapter is removed from the bore of the casing hanger.

3. The injection well according to claim 1 further comprising a closure means for selectively closing the port when the injection adapter is removed from the bore of the casing hanger, the closure means comprising a sleeve which is adapted to removably insert into the bore.

4. The injection well according to claim 1 wherein the injection adapter has an upper portion extending in the inner wellhead housing above the casing hanger, and wherein the injection well further comprises:

upper seal means for sealing the upper portion of the injection adapter to the inner wellhead housing.

5. The injection well according to claim 1, further comprising:

internal valve means located in the passage of the injection adapter for selectively opening and closing the passage.

6. The injection well according to claim 1 wherein the passage of the injection adapter has an axial portion and at least one lateral portion extending from the axial portion into registry with the port in the casing hanger, and wherein the injection well further comprises:

internal valve means located in the axial portion of the passage of the injection adapter and slidably movable between open and closed portions for selectively opening and closing the lateral portion of the passage.

7. The injection well according to claim 1 wherein the passage of the injection adapter has an axial portion and at least one lateral portion extending from the axial portion into registry with the port in the casing hanger, and wherein the injection well further comprises:

internal valve means located in the axial portion of the passage of the injection adapter and slidably movable between open and closed positions for selectively opening and closing the lateral portion of the passage; and wherein the connection means includes external actuator means for removable connection to the injection adapter and for hydraulically moving the internal valve means between the upper and lower positions.

8. The injection well according to claim 1 wherein the passage of the injection adapter has an axial portion and at least one lateral portion extending from the axial portion into registry with the port in the casing hanger, and wherein the injection well further comprises:

internal valve means located in the axial portion of the passage of the injection adapter and axially movable between open and closed positions for selectively opening and closing the lateral portion of the passage, the internal valve means being biased toward the closed position; and wherein the connection means includes external actuator means for removable connection to the injection adapter and for hydraulically moving the internal valve means between the open and closed positions.

9. In an injection well having an outer wellhead housing, an inner wellhead housing landed in the outer wellhead housing, at least one casing hanger landed in the inner wellhead housing, the casing hanger having an axial bore and being secured to a string of casing, pump means for delivering a slurry of well cuttings produced from the drilling of another well, the improvement comprising in combination:

a port extending through the casing hanger from a port entrance section in the bore to an annulus surrounding the casing;

a closure sleeve adapted to be placed in the port entrance section in the bore of the casing hanger for selectively closing the port;

an injection adapter which is adapted to removably land in the bore of the casing hanger when the closure sleeve is removed from the port entrance section, the injection adapter having a passage therethrough which has an axial portion and at least one lateral portion which is adapted to communicate with the port;

lower seal means for sealing the injection adapter in the bore of the casing hanger;

internal valve means located in the axial portion of the passage of the injection adapter and axially movable between open and closed positions for selectively opening and closing the lateral portion of the passage, the internal valve means being biased toward the closed position; and hydraulic actuator means for moving the internal valve means between the open and closed positions, the actuator means being connected to the pump means for delivering the slurry through the passage and port into the annulus.

10. The injection well according to claim 9 wherein the closure sleeve is removed from the casing hanger when the injection adapter is inserted into the bore.

11. The injection well according to claim 8 wherein the injection adapter has an upper portion extending in the inner wellhead housing above the casing hanger, and wherein the injection adapter further comprises:

upper seal means for sealing the upper portion of the injection adapter to the inner wellhead housing.

12. The injection well according to claim 8 wherein the actuator means is located externally of the injection adapter and removably secured thereto.

13. In a subsea injection well having an outer wellhead housing secured to a string of conductor pipe, an inner wellhead housing landed in the outer wellhead housing and secured to a string of outer casing, a lower casing hanger landed in the inner wellhead housing and secured to a string of intermediate casing, an upper casing hanger landed in the inner wellhead housing on top of the lower casing hanger and secured to a string of inner casing, defining an annulus between the inner and intermediate casings, the upper casing hanger having a bore, pump means on a platform at the surface for delivering a slurry of well cuttings produced from the drilling of another well, the improvement comprising in combination:

a port extending through the upper casing hanger to the annulus;

an injection adapter which is adapted to be removably inserted in the bore of the upper casing hanger, the injection adapter having a passage therethrough which is adapted to communicate with the port;

lower seal means for sealing the injection adapter in the bore of the upper casing hanger;

connection means for connecting the passage of the injection adapter to the pump means for delivering the slurry through the passage and port into the annulus; and a tieback connector adapted to be inserted into the bore of the upper casing hanger after injection into the injection well has be completed and the injection adapter retrieved to the platform, the tieback connector being secured to the lower end of a string of tieback conduit extending to the platform for completing the injection well into a production well.

14. The injection well according to claim 13 further comprising closure means for closing the port when the injection adapter is removed from the bore and for opening the port when the injection adapter is to be inserted into the bore.

15. The injection well according to claim 13 further comprising a closure sleeve which is adapted to be inserted into the bore before insertion of the injection adapter to close the port and adapted to be removed from the bore to open the port when the injection adapter is to be inserted into the bore.

16. The injection well according to claim 13 wherein the injection adapter has an upper portion extending in the inner wellhead housing above the casing hanger, and wherein the injection adapter further comprises:

upper seal means for sealing the upper portion of the injection adapter to the inner wellhead housing.

17. The injection well according to claim 13, further comprising:

internal valve means located in the passage of the injection adapter for selectively opening and closing the passage.

18. The injection well according to claim 13 wherein the passage of the injection adapter has an axial portion and at least one lateral portion extending from the axial portion into registry with the port in the casing hanger, and wherein the injection adapter further comprises:

internal valve means located in the axial portion of the passage of the injection adapter and slidably movable between open and closed portions for selectively opening and closing the lateral portion of the passage.

19. The injection well according the claim 13 wherein the passage of the injection adapter has an axial portion and at least one lateral portion extending from the axial portion into registry with the port in the casing hanger, and wherein the injection adapter further comprises:

internal sleeve valve means located in the axial portion of the passage of the injection adapter and slidably movable between upper and lower positions for selectively opening and closing the lateral portion of the passage; and wherein the connection means includes actuator means for hydraulically moving the internal sleeve valve means between the upper and lower positions.

20. The injection well according to claim 19 wherein the passage of the injection adapter has an axial portion and at least one lateral portion extending from the axial portion into registry with the port in the casing hanger, and wherein the injection adapter further comprises:

internal sleeve valve means located in the axial portion of the passage of the injection adapter and axially movable between open and closed positions for selectively opening and closing the lateral portion of the passage, the internal sleeve valve means being biased toward the closed position; and wherein the connection means includes external actuator means for removable connection to the injection adapter and for hydraulically moving the internal sleeve valve means between the open and closed positions.

21. A method for disposing of a slurry of well cuttings provided by a pump means from the drilling of a subsea well, comprising:

forming a portion of a subsea injection well and installing an outer wellhead housing;

drilling another portion of the injection well and installing an inner wellhead housing in the outer wellhead housing;

providing a casing hanger with an axial bore and a port extending from the bore to the exterior of the casing hanger;

closing the port;

drilling another portion of the injection well and securing the casing hanger to a string of casing and installing the casing hanger in the inner wellhead housing with the port closed;

opening the port, thereby communicating the bore of the casing hanger with an annulus surrounding the casing;

landing and sealing an injection adapter in the bore of the casing hanger, the injection adapter having a passage therethrough which communicates with the port; and connecting the passage of the injection adapter to the pump means and delivering the slurry through the passage and port into the annulus.

22. The method according to claim 21 wherein the step of closing the port comprises placing a sleeve in the bore of the casing hanger, and the step of opening the port comprises removing the sleeve from the bore of the casing hanger prior to landing the injection adapter.

23. The method according to claim 21 further comprising:

sealing an upper portion of the injection adapter to the inner wellhead housing.

24. The method according to claim 21 further comprising:

placing an internal sleeve valve in the passage of the injection adapter and selectively opening and closing the passage.

25. The method according to claim 21, further comprising after completing the injection of the slurry into the injection well:

pumping cement through the injection adapter into the annulus; then removing the injection adapter;

closing the port; and completing the injection well for production.

26. A method for disposing of a slurry of well cuttings provided by a pump means from the drilling of a subsea well, comprising:

forming a portion of a subsea injection well and installing an outer wellhead housing attached to the upper end of a string of conductor pipe;

drilling a second portion of the injection well and installing an inner wellhead housing in the outer wellhead housing, the inner wellhead housing being attached to a string of outer casing;

drilling a third portion of the injection well and installing a lower casing hanger in the outer wellhead housing, the lower casing hanger being attached to a string of intermediate casing;

providing an upper casing hanger with an axial bore and a port extending from the bore to the exterior of the casing hanger;

closing the port;

drilling a fourth portion of the injection well and securing the upper casing hanger to a string of inner casing and installing the inner casing hanger in the inner wellhead housing above the lower casing hanger and with the port closed;

opening the port, thereby communicating the bore of the casing hanger with an annulus surrounding the inner casing;

landing and sealing an injection adapter in the bore of the casing hanger, the injection adapter having a passage therethrough which communicates with the port;

connecting the passage of the injection adapter to the pump means and delivering the slurry through the passage and port into the annulus; then, when the injection has been completed, pumping cement through the injection adapter into the annulus; then removing the injection adapter from the inner casing hanger;

closing the port; then installing a tieback connector on a lower end of a string of tieback conduit and inserting the tieback connector into the bore of the casing hanger; then completing the injection well for production.

27. The method according to claim 26 wherein the step of closing the port comprises placing a sleeve in the bore of the upper casing hanger, and the step of opening the port comprises removing the sleeve from the bore of the inner casing hanger prior to landing the injection adapter.

28. The method according to claim 26 further comprising:

sealing an upper portion of the injection adapter to the inner wellhead housing.

29. The method according to claim 26 further comprising:

placing an internal sleeve valve in the passage of the injection adapter and selectively opening and closing the passage.

* * * * *

UNITED STATES PATENT AND TRADEMARK OFFICE

CERTIFICATE OF CORRECTION

PATENT NO. : 5,339,912

DATED : 08/23/94

INVENTOR(S) : STANLEY HOSIE, ET AL.

It is certified that error appears in the above-indentified patent and that said Letters Patent is hereby corrected as shown below:

Column 6, line 15, "adapted" should be --adapter--;

Column 6, line 22, "adapted" should be --adapter--.

Signed and Sealed this

Twentieth Day of December, 1994

*Attest:*

Bruce Lehman

BRUCE LEHMAN

*Attesting Officer*

*Commissioner of Patents and Trademarks*